US009781986B2

(12) United States Patent
Merzon

(10) Patent No.: US 9,781,986 B2
(45) Date of Patent: Oct. 10, 2017

(54) HOLSTER FOR HANDHELD RADIO

(71) Applicant: Richard H. Merzon, Far Hills, NJ (US)

(72) Inventor: Richard H. Merzon, Far Hills, NJ (US)

( * ) Notice: Subject to any disclaimer, the term of this patent is extended or adjusted under 35 U.S.C. 154(b) by 59 days.

(21) Appl. No.: 14/839,095

(22) Filed: Aug. 28, 2015

(65) Prior Publication Data

US 2017/0055659 A1 Mar. 2, 2017

(51) Int. Cl.

| | |
|---|---|
| ***B65D 83/00*** | (2006.01) |
| ***A45C 1/04*** | (2006.01) |
| ***A45C 3/00*** | (2006.01) |
| ***F41C 33/02*** | (2006.01) |
| ***B65D 25/10*** | (2006.01) |
| ***A45C 11/00*** | (2006.01) |
| ***A45F 5/02*** | (2006.01) |

(52) U.S. Cl.

CPC ..... *A45C 11/00* (2013.01); *A45F 5/021* (2013.01); *A45C 2011/002* (2013.01); *A45F 2200/0516* (2013.01)

(58) Field of Classification Search

CPC ..... A45C 11/00; A45C 2011/002

USPC ..... 224/245, 196, 673, 669, 670, 246

See application file for complete search history.

(56) References Cited

U.S. PATENT DOCUMENTS

| | | | | |
|---|---|---|---|---|
| 2,779,522 | A * | 1/1957 | Puckett | F42B 39/002 221/185 |
| 4,858,798 | A * | 8/1989 | Siddoway | A45F 5/02 224/240 |
| 5,174,482 | A * | 12/1992 | Rogers | F42B 39/02 221/185 |
| 5,392,975 | A * | 2/1995 | Blankenship, Jr. | B05B 9/08 206/317 |
| 5,449,104 | A * | 9/1995 | Parsons | A45F 5/02 224/245 |
| 6,145,654 | A * | 11/2000 | Loghman | F41H 9/10 206/37 |
| 2002/0162849 | A1* | 11/2002 | Chen | B65D 83/087 221/65 |
| 2007/0039989 | A1* | 2/2007 | Nistico | A45F 5/02 224/674 |

(Continued)

*Primary Examiner* — Adam Waggenspack
*Assistant Examiner* — Lester L Vanterpool
(74) *Attorney, Agent, or Firm* — R. Tracy Crump

(57) ABSTRACT

The radio holster incorporated a lock mechanism that automatically actuates when the radio is inserted into the holster and is deactivated by pressing on the radio in a small downward and outward direction. The radio holster includes pliable front and back covers affixed to a rigid support frame. The support frame has a recessed channel that as a guide track and a button cavity that acts as keyhole for locking the radio inside holster. The wall forming the button cavity wall is back cut or angled to form an upper lip, which is configured to receive the button head of a coupling mechanism used by the radio to restrictively hold the radio within the holster. The support frame also carries a back spring that exerts a lateral force on the radio when seated within the holster to push the bottom of the radio laterally away from the support frame and a bottom spring that exerts a force on the radio when seated within the holster to push the bottom of the radio upward within the holster.

13 Claims, 11 Drawing Sheets

(56) References Cited

U.S. PATENT DOCUMENTS

| | | | | |
|---|---|---|---|---|
| 2007/0278269 | A1* | 12/2007 | Rogers | F42B 39/02<br>224/239 |
| 2008/0087695 | A1* | 4/2008 | Froelich | A45F 5/02<br>224/196 |
| 2012/0055822 | A1* | 3/2012 | Bullock | A45C 11/00<br>206/320 |
| 2014/0053385 | A1* | 2/2014 | Nielsen-Cole | A45F 5/021<br>29/426.1 |

* cited by examiner

HOLSTER FOR HANDHELD RADIO

This invention relates to a holster for carrying hand held devices, such as radios, GPS and phones, and in particular a holster for carrying a police radio.

BACKGROUND AND SUMMARY OF THE INVENTION

Handheld electronic devices, such as cell phones, radios and GPS devices are often carried in clothing pockets or carrying pouches worn by users. Law enforcement personnel, in particular, frequently carry their police radios in pouches attached to their utility belts. Conventional radio pouches allow radios to be securely carried, but do not allow the radios to be conveniently accessed or accessed with a single hand.

The radio holster of this invention provides a holster that securely locks a handheld radio within the holster body, but allows the radio to be easily withdrawn from the holster with simple gross motor skills of one hand. The holster incorporates a lock mechanism that automatically actuates when the radio is inserted into the holster and is deactivated by pressing on the radio in a small downward and outward direction. Consequently, the holster allows the user the ability to immediate holster and withdraw the radio without needing to activate or deactivate the lock mechanism.

The radio holster includes pliable front and back covers affixed to a rigid support frame. The support frame has a recessed channel that has a guide track and a button cavity that acts as a keyhole for locking the radio inside the holster. The wall forming the button cavity wall is back cut or angled to form an upper lip, which is configured to receive the button head of a coupling mechanism used by the radio to restrictively hold the radio within the holster. The support frame also carries a pair of internal cantilever springs. A back spring exerts a lateral force on the radio when seated within the holster to push the bottom of the radio laterally away from the support frame. A bottom spring exerts a force on the radio when seated within the holster to push the bottom of the radio upward within the holster.

The radio is inserted into the holster against the upward force of the bottom spring. As the radio is manually inserted into the holster, the button head of the radio connector rides along the channel toward the button cavity. As the radio is pushed completely into the holster, a back spring pushes the bottom of the radio away from the support frame to push the button head into the button cavity of the support frame. Once fully seated within the holster, the bottom spring exerts an upward force on the bottom of the radio to lift it slightly so that the button head of the radio slides under the lip formed in the support frame, thereby locking the radio within the holster. The radio is removed from the holster by initially pushing downward on the radio against the upward force of the spring, which slides the button head from under the lip and outward, which unseats the button head from the button cavity, thereby unlocking the radio so that it can be manually lifted from the holster.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
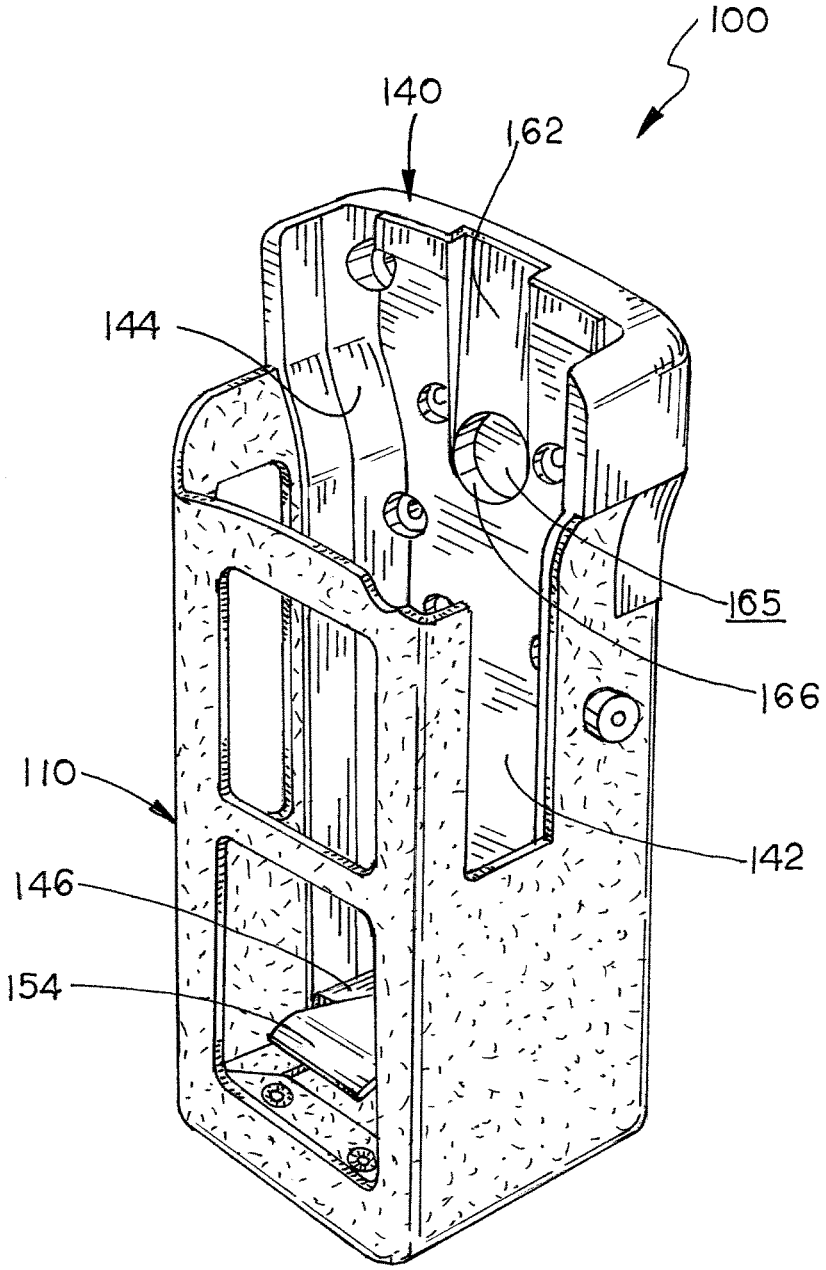
FIG. 1 is a perspective view of an embodiment of the radio holster of this invention.

In the following detailed description of the preferred embodiments, reference is made to the accompanying drawings that form a part hereof, and in which is shown by way of illustration, specific preferred embodiments in which the invention may be practiced. These embodiments are described in sufficient detail to enable those skilled in the art to practice the invention, and it is understood that other embodiments may be utilized and that logical, structural and mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-8 illustrate an embodiment of the present invention where the holster is designated generally as reference numeral 100 in use with a handheld police radio 10. As shown, holster 100 is designed and dimensioned for use with a particular police style handheld radio; however, the teaching of this invention may be adapted for use with any handheld radio or electronic device, including but not limited to cell phones, PDAs, GPS and recording devices, cameras and the like. Radio 10 has a generally rectangular body with various buttons, switches and display panels. As common with law enforcement and military style radios, radio 10 includes mount 20 as part of a quick connect mechanism for conveniently coupling the radio to a mating adapter carried on a duty belt or other load bearing equipment. Such quick connect mechanisms are commonly used and well know in the arts. As shown, mount 20 is a conventional button style mount and includes a flat button head 22 formed atop a short neck 24 protruding from the back of radio 10.

Holster 100 includes pliable front and back covers 110 and 120, a quick connect mount 130, and a rigid support frame 140. Front and back covers 110 and 120 are cut and fashioned or otherwise constructed from leather or other suitable durable materials and fabrics. Front cover 110 is shaped and formed to provide the front wall and sidewalls of holster 100. Back cover 120 is shaped and formed to cover the back of support frame 140 and provide the bottom of holster 100. Front cover 110 has various opening and cutouts to provide access to the various switches, knobs, controls, antennas and displays of the particular model or style of radio. Front and back covers 110 and 120 are joined together and affixed to support frame by suitable adhesives, rivets and other suitable fasteners.

Like mount 20 of radio 10, quick connect mount 130 is part of a quick connect mechanism for conveniently coupling holster 100 to a mating adapter carried on a duty belt or other load bearing equipment. Again, such quick connect mechanisms are commonly used and well know in the arts. As shown, mount 130 includes a base plate 132 affixed to back cover 130, a short neck 134 extending from the plate and terminating in a flat circular head 136. Head 136 is configured and dimension to restrictively seat within a receiver part of a corresponding couple. In certain other embodiments, the holster of this invention may employ different mounts to accommodate any type or style of quick connect mechanism as desired.

Figure 2:
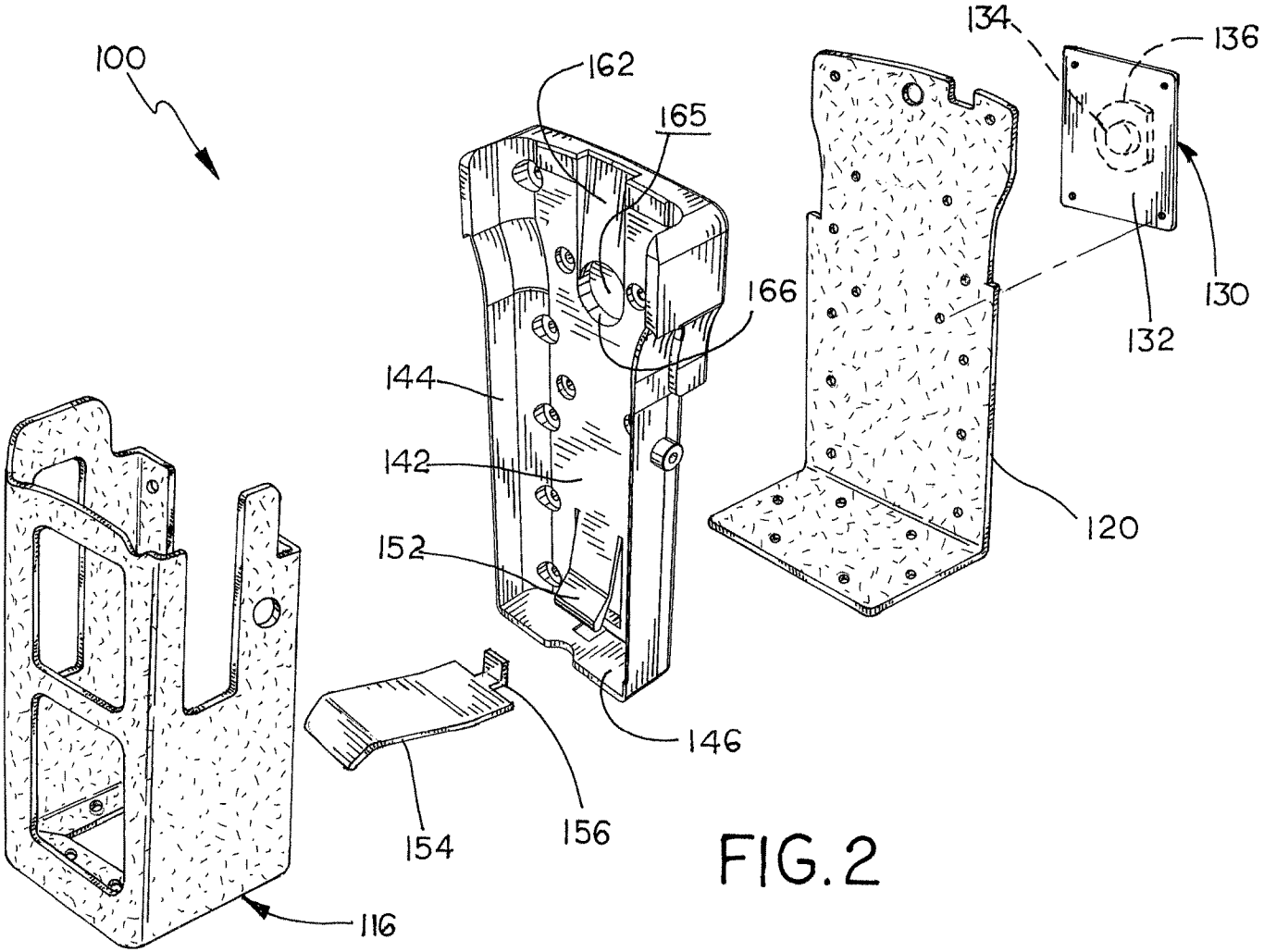
FIG. 2 is an exploded view of the radio holster of FIG. 1.

Support frame 140 is molded or otherwise constructed of a suitable plastic polymer material. The polymer construction affords the holster the necessary strength and durability for extended rugged use. Support frame 140 is configured to receive the rear half of radio 10 in a vertical orientation. As shown in FIG. 2, support frame 140 has a back wall 142, a pair of side walls 144, and a bottom wall 146.

Support frame 140 also carries a pair of internal cantilever springs 152 and 154. An integral back spring 152 is integrally formed the body of support frame 140 and extends inward from back wall 142. Spring 152 exerts a lateral force on radio 10 when seated within holster 100 to push the bottom of the radio away from back wall 112. A separate bottom spring 154 is connected to support frame 140 to overlie the bottom of holster 100. Spring 154 exerts an upward force on radio 10 when seated within holster 100 to push the bottom of the radio away from bottom wall 116. As shown, spring 154 is stamped or cut from a suitable resilient flat sheet of metal and bent to shape. Spring 154 has an L-shaped leg 156 that restrictively seats within a slot 157 and engages the back of support frame 140 to hold the spring in place at the bottom of the holster interior.

Support frame 140 also has a recessed channel 161 that terminates in a button cavity 165. Channel 161 acts as a track for guiding radio 10 into holster 100 and is defined by opposed sidewall and an angled channel wall 162. Button cavity 165 acts as a keyhole for locking radio 10 inside holster 100. Button cavity 165 is defined by an annular side wall 166. As shown in FIGS. 3 -8, the upper face of cavity wall 166 is back cut or angled to form an angled upper lip 168. Button cavity 165 is dimensioned to receive button head 20 of radio 10 and for the button head to restrictively seat under lip 168.

Figure 3:
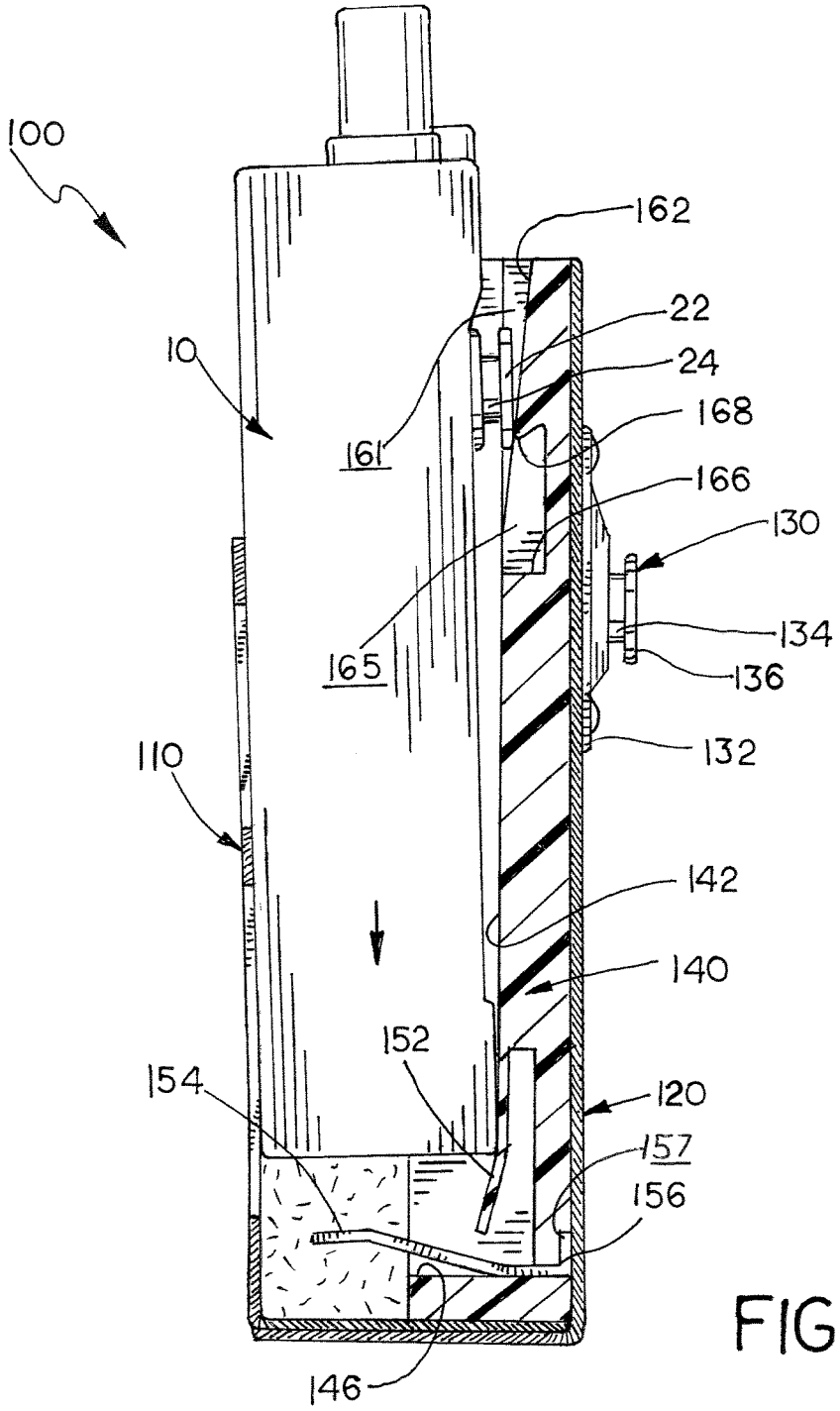
FIG. 3 is a left side sectional view of the radio holster of FIG. 1 showing a radio being initially inserted into the holster.
Figure 4:
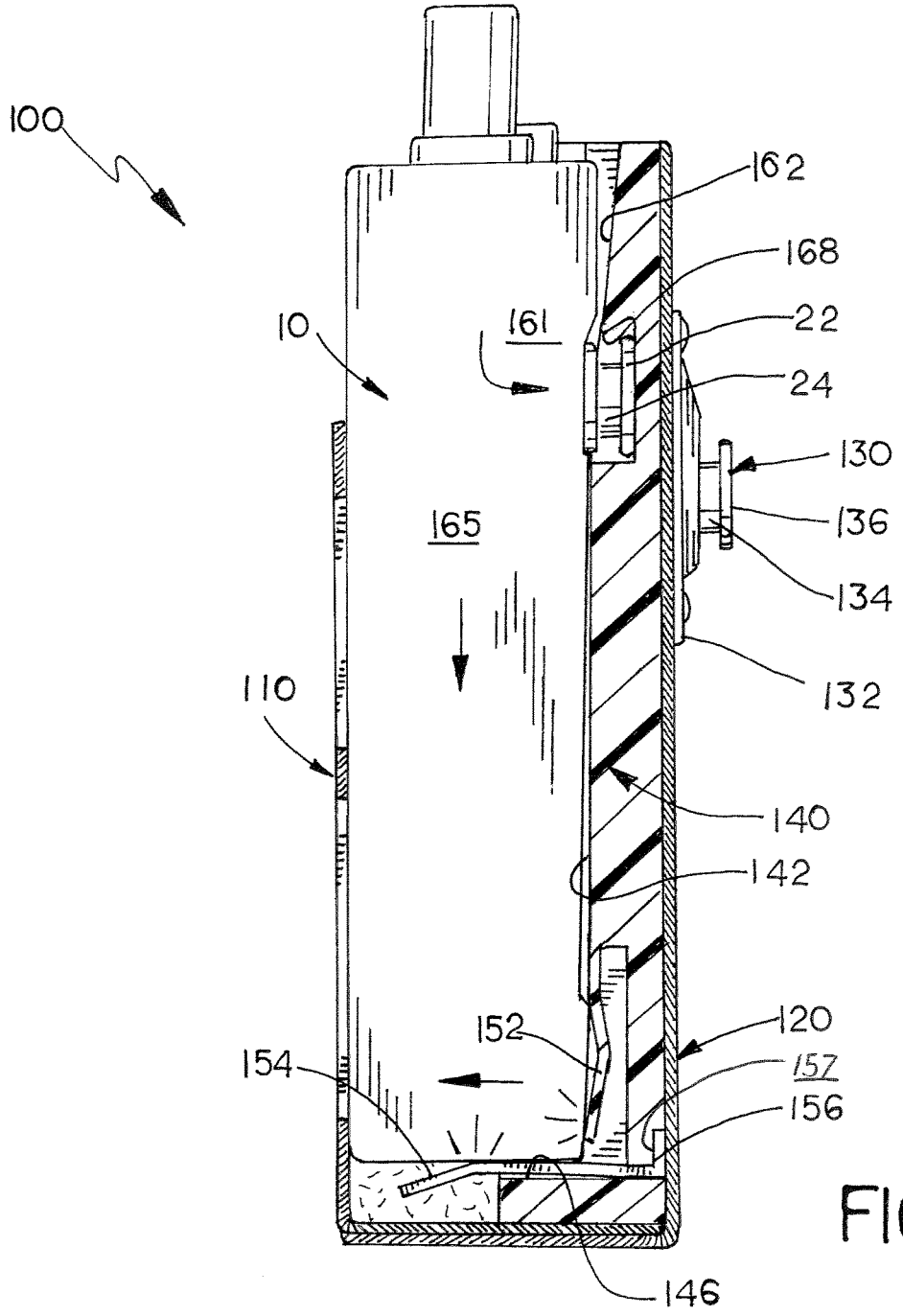
FIG. 4 is a left side sectional view of the radio holster of FIG. 1 showing a radio being inserted into the holster to compress the bottom spring.
Figure 5:
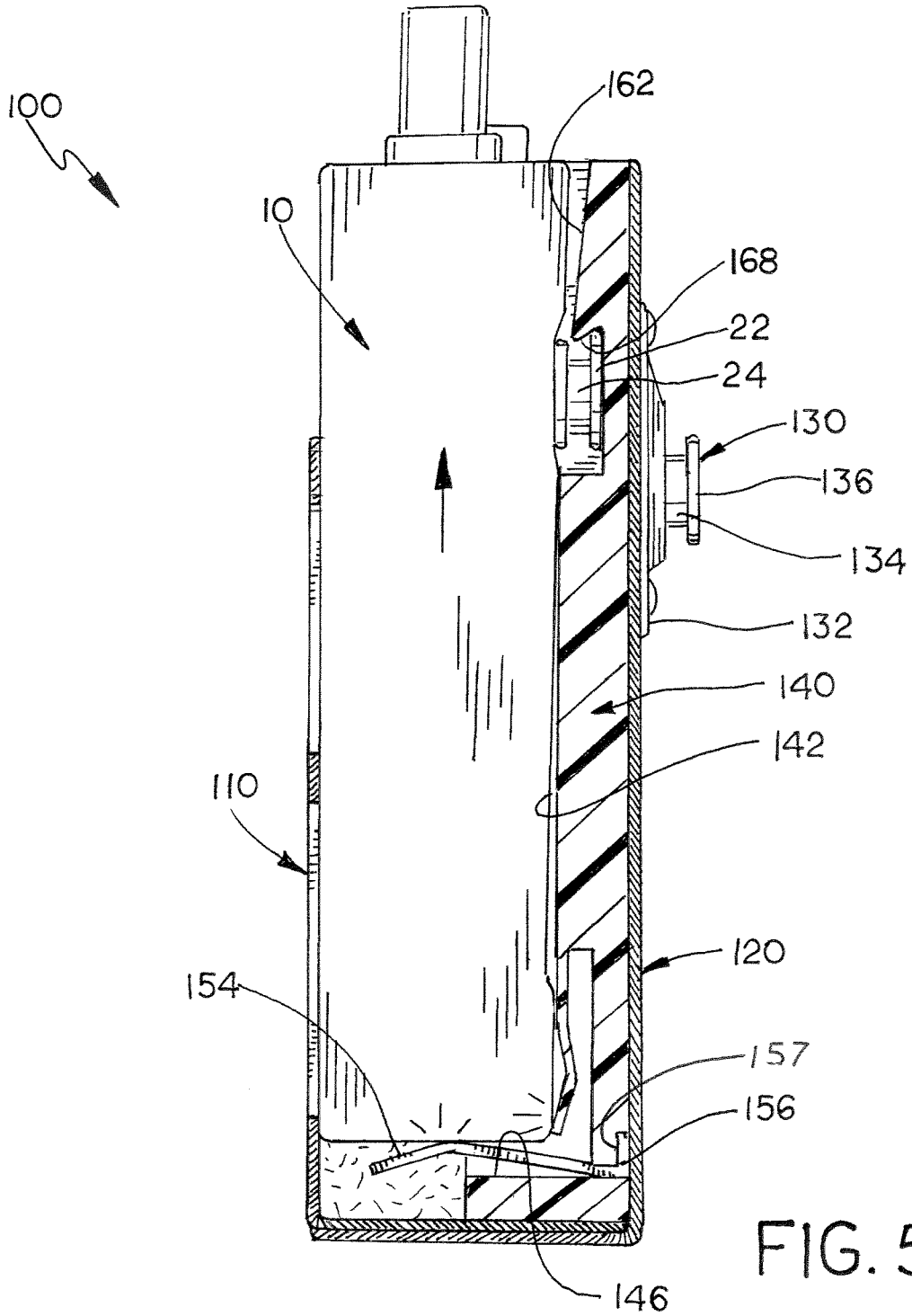
FIG. 5 is a left side sectional view of the radio holster of FIG. 1 showing the radio inserted into the holster with the button head seated within the button cavity.
Figure 6:
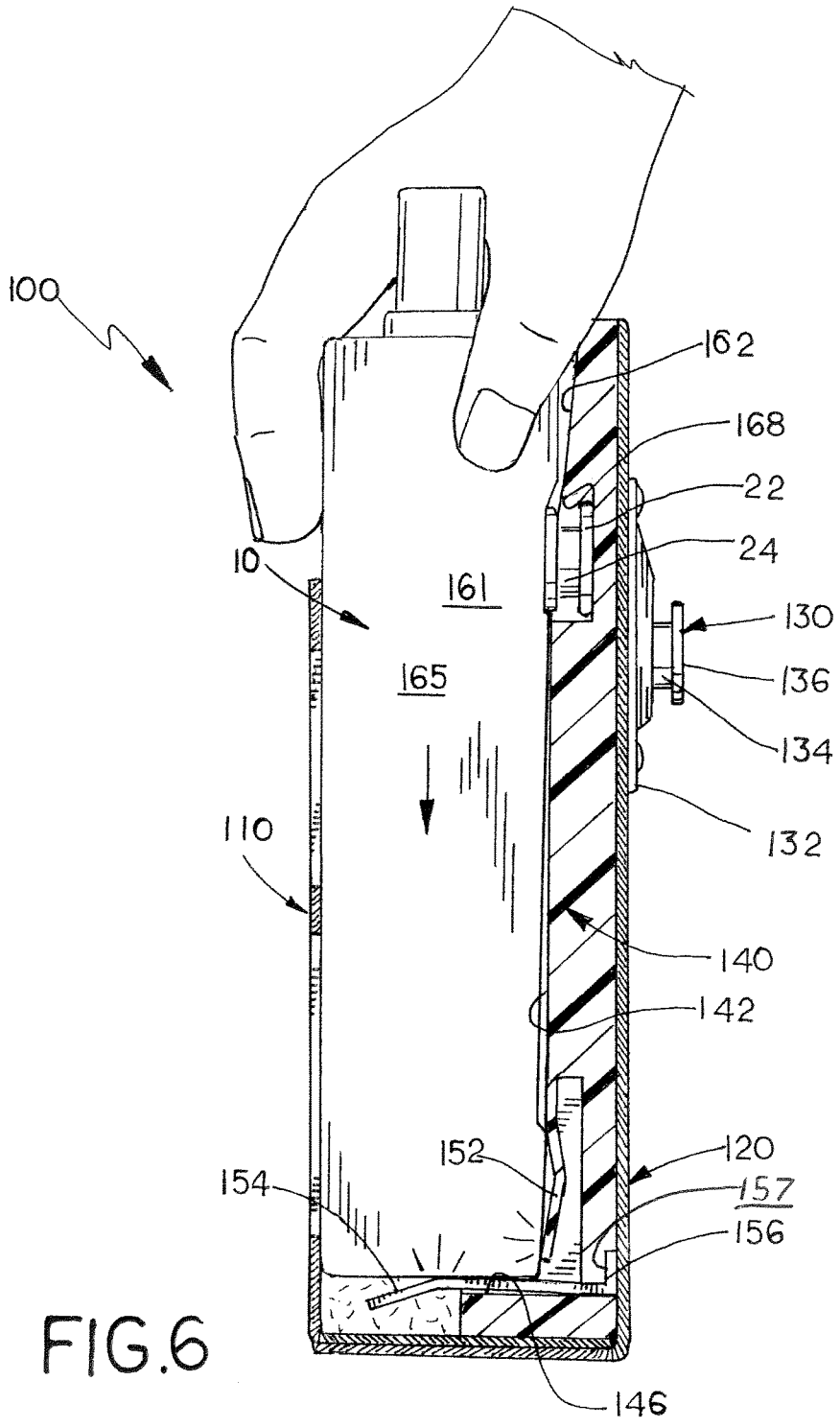
FIG. 6 is a left side sectional view of the radio holster of FIG. 1 showing the radio being pressed downward to compress the bottom spring.
Figure 7:
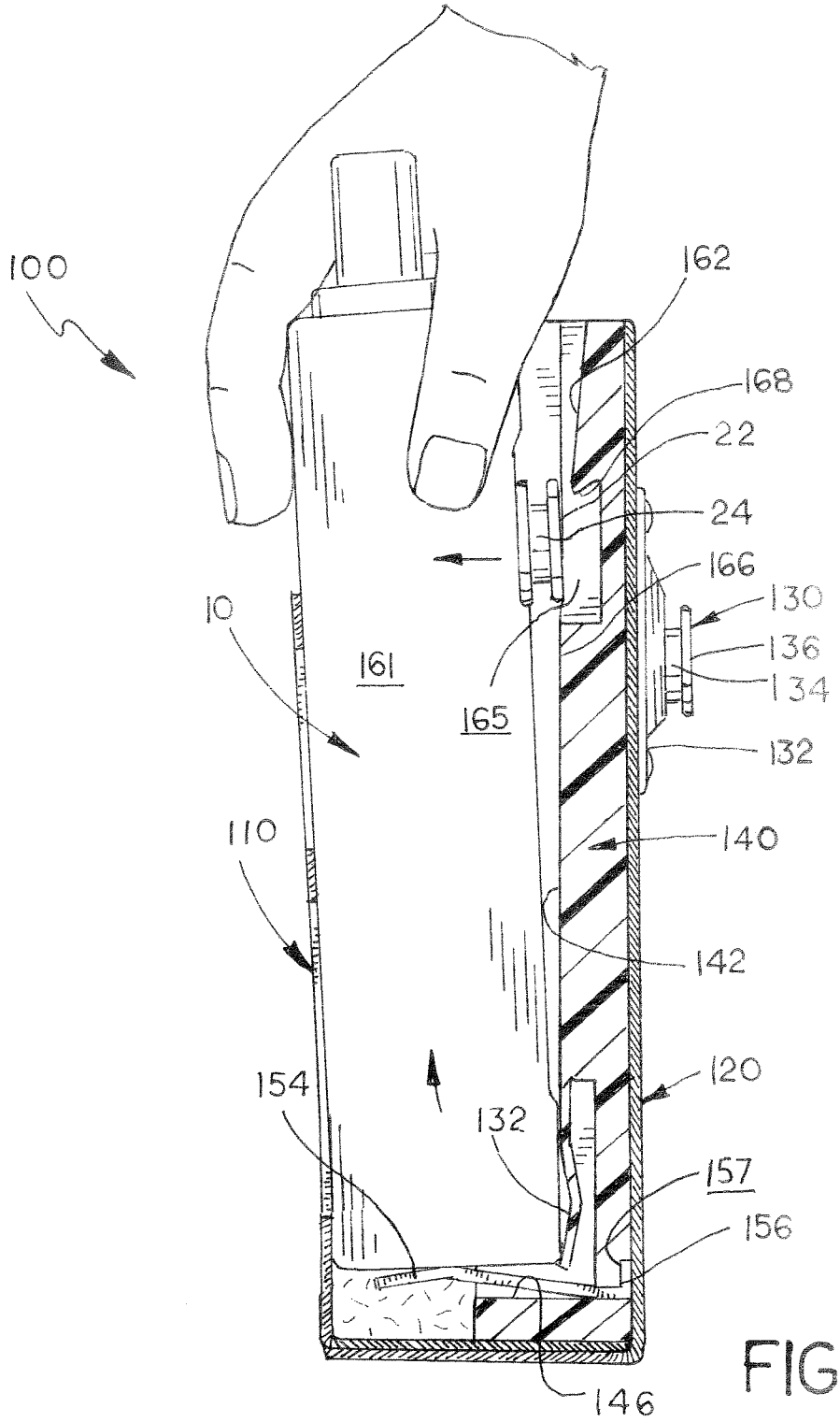
FIG. 7 is a left side sectional view of the radio holster of FIG. 1 showing the button head unseated from the button cavity.
Figure 8:
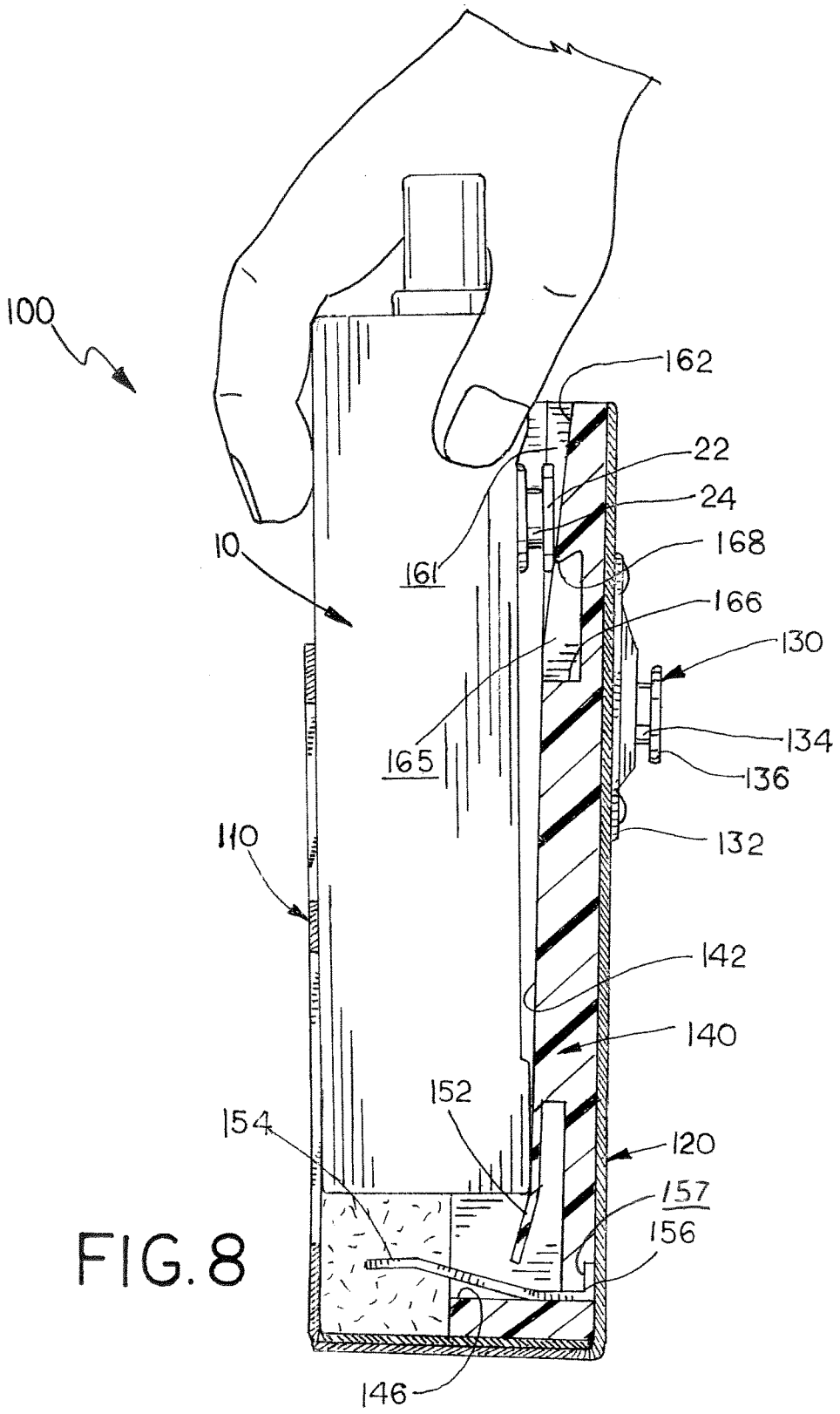
FIG. 8 is a left side sectional view of the radio holster of FIG. 1 showing the radio being lifted from the holster.

FIGS. 3-8 illustrate how radio 10 is securely seated and removed from holster 100. Radio 10 is inserted by physically pushing the radio downward into holster 100 against the upward force of spring 154. As radio 10 is manually inserted into holster 100, button head 20 rides along channel 161 toward button cavity 165 (FIG. 3). As radio 10 is pushed completely into holster 100, spring 152 exerts a lateral force on the bottom of radio 10 to push the radio bottom away from support frame 140, which pivots the radio and seats button head 20 into button cavity 165 (FIG. 4). Once fully seated within holster 100, spring 154 exerts an upward force on the bottom of the radio to lift it slightly so that the top edge of button head 20 slides under lip 168, thereby locking the radio within holster 100 (FIG. 5). Radio 10 is removed from holster 100 by initially pushing downward on the radio against the upward force of spring 154, which slides button head 20 from under lip 168 (FIG. 6). Simultaneously while pushing down, the user pushes the top of radio 10 outward to unseat button head 20 from button cavity 165, thereby unlocking the radio from holster 100 (FIG. 7). Once unlocked, radio 10 can be manually lifted from holster 100 (FIG. 8).

Figure 9:
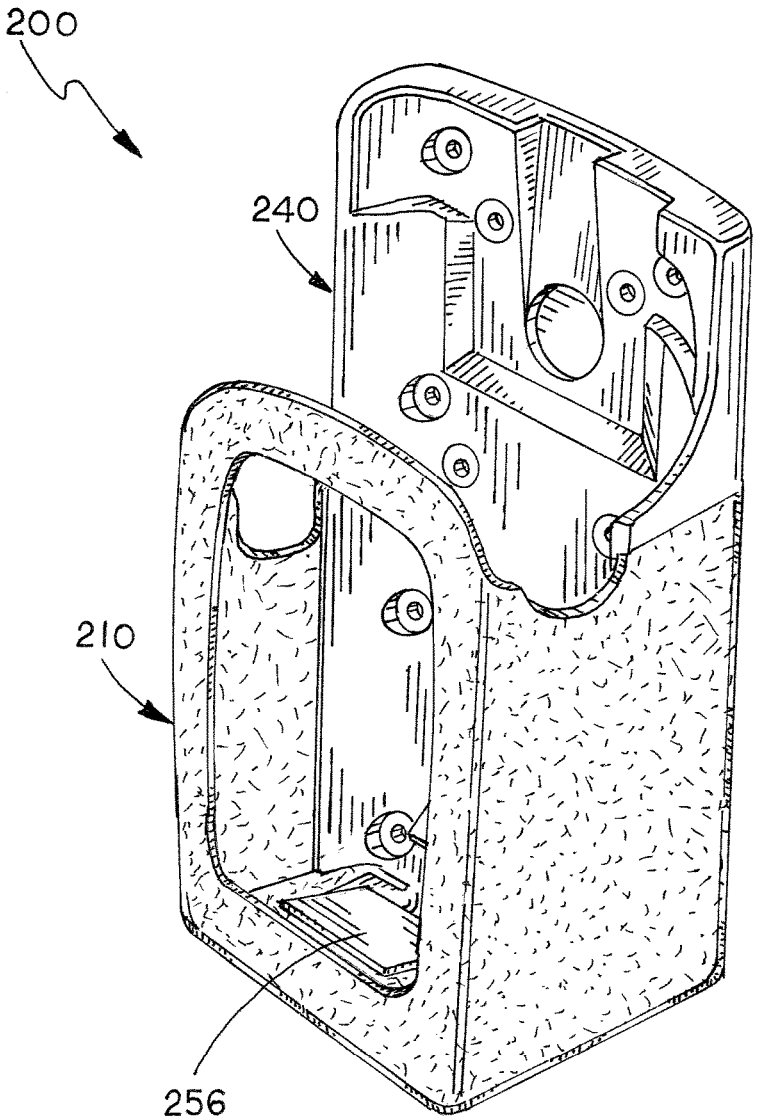
FIG. 9 is a perspective view of a second embodiment of the radio holster of this invention.
Figure 10:
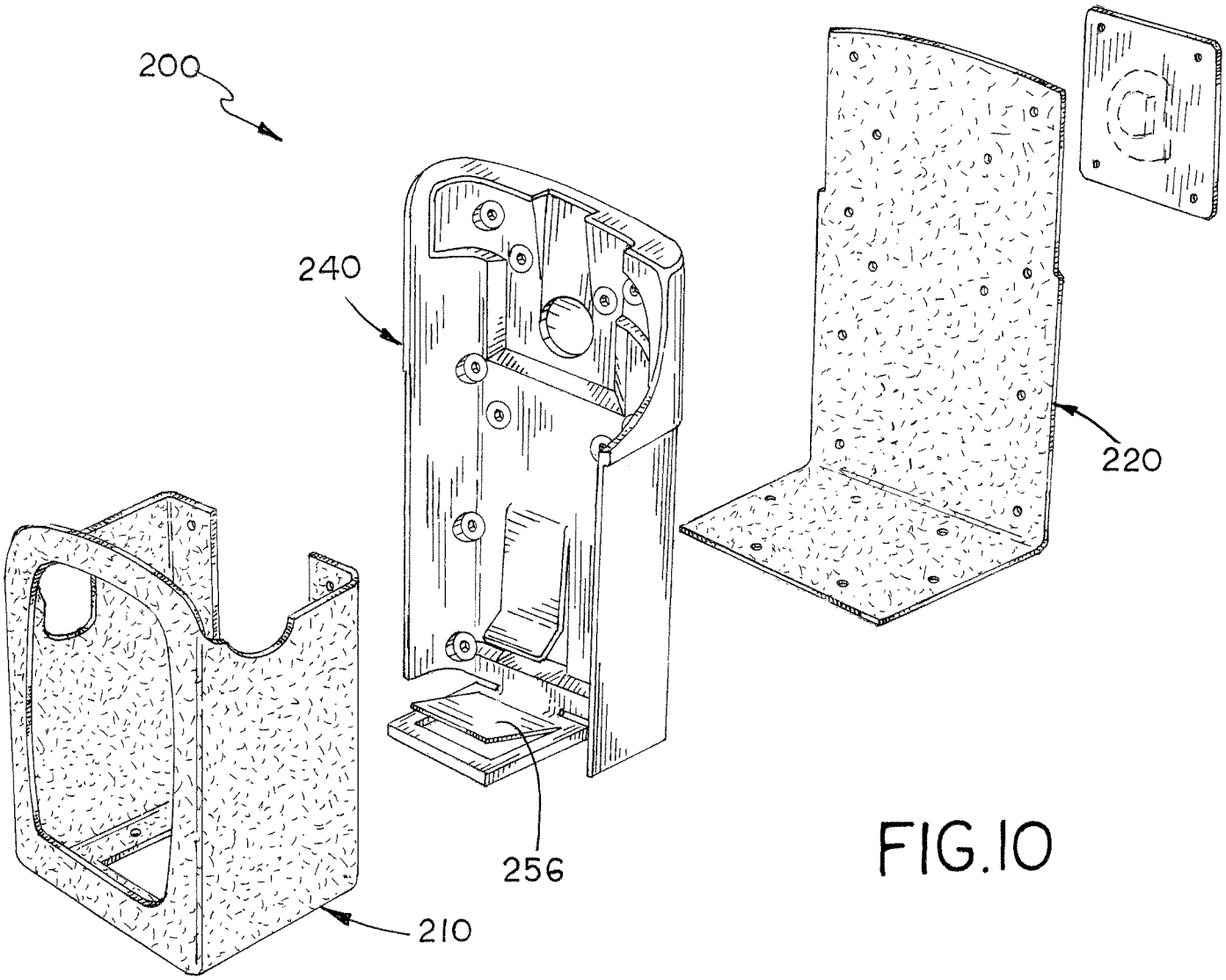
FIG. 10 is an exploded view of the radio holster of FIG. 9.
Figure 11:
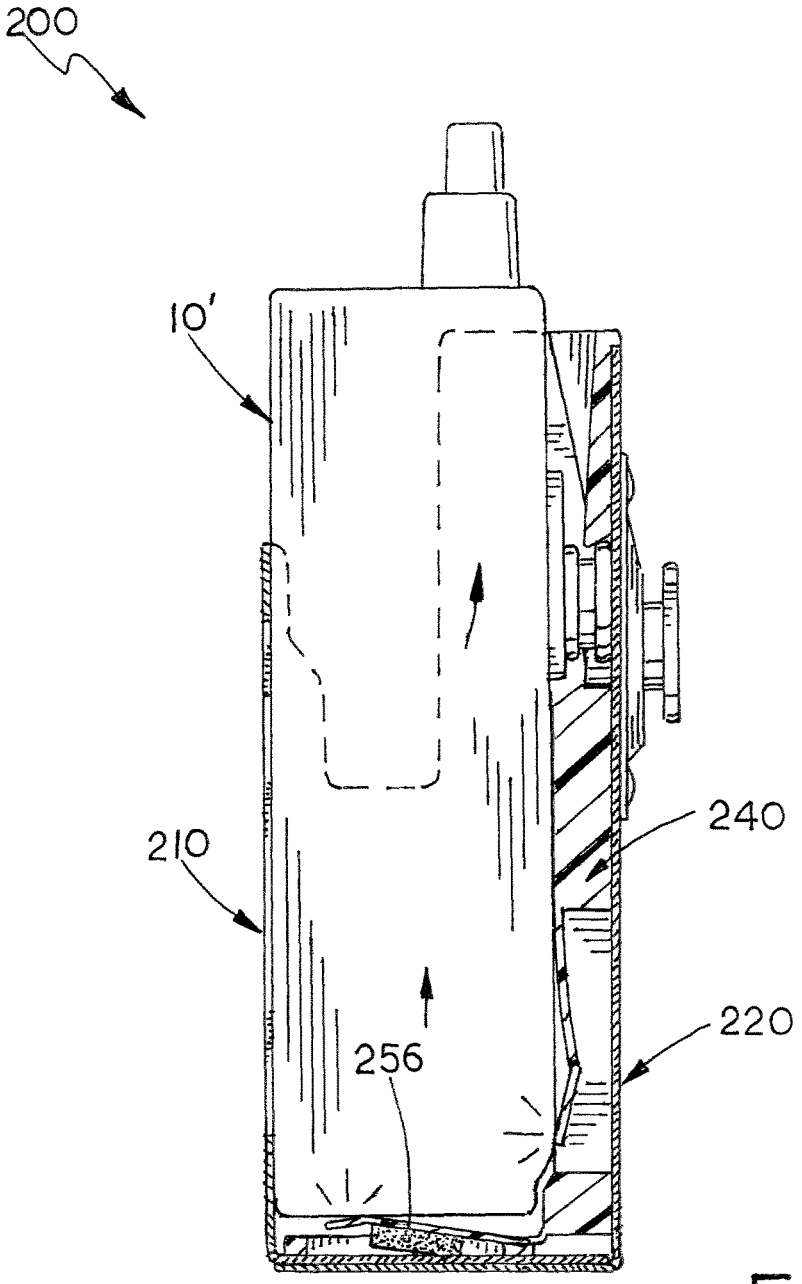
FIG. 11 is a left side sectional view of the radio holster of FIG. 9.

FIGS. 9-11 show additional embodiments of the holster of this present invention, which is designated as reference numeral 200. Holster 200 is identical to holster 100 in design and function, except that the separate metal spring 156 of holster 100 is replaced by a bottom spring 256 integrally formed as part of the body of support frame 240. In addition, the front and rear covers 210 and 220 are configured to accommodate a different style or model of radio.

Other embodiments of this invention may vary slightly in configuration and style, but every embodiment uses a back cut upper lip or edge formed in the support frame and a bottom spring element that exerts an upward force on the device to provide the locking mechanism that secures the device within the holster. In certain embodiments of this invention, the support frames may incorporate any suitable spring mechanism to provide the upward and lateral forces, which seat and lock the device within the holster. The springs forces may be provided by any suitable spring mechanism, such as bar, leaf or coil springs or resilient compressive components, such as elastomers and the like. For any particular embodiment, the spring mechanisms either the upward or lateral force may take the form of a separate component or be integrally formed into the body of the support frame and appropriate. In some embodiments, only the bottom spring is necessary to lock the device in place, while allowing the radio to be readily unlocked and drawn from the holster.

One skilled in the art will note that the use of a back cut upper lip or edge formed in the support frame and a bottom spring element securely lock a device within the holster body, while still allowing the device to be easily withdrawn from the holster with simple gross motor skills of one hand. The locking mechanism of this invention automatically actuates when the device is inserted into the holster and is deactivated by simply pressing on the device with a small downward and outward motion. Consequently, the holsters allows the user the ability to immediately holster and withdraw the device without needing to activate or deactivate the lock mechanism.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A holster for a handheld device where the device includes a quick connect mechanism having a button head extending laterally therefrom, the holster comprising:

a support frame; and a holster cover mounted to the support frame to define a holster interior for receiving the device therein, the support frame includes a back wall and bottom wall, the back wall has a cavity adapted to restrictively receive the button head of the device, the support frame also includes a first spring part extending over the bottom wall and a second spring part extending over the back wall, the first spring part adapted to exert an upward force on the device when the device is seated within the holster interior to hold the button head within the cavity, thereby locking the device within the holster interior, the second spring part adapted to exert an outward force on the device when the device is seated within the holster interior to push the device outward away from the support frame for seating the button head into the cavity of the back wall.

2. The holster of claim 1 wherein the cavity is defined by an annular side wall having a back cut portion thereof forming a lip part, the button head to restrictively seat under the lip when the device is locking into the holster interior.

3. The holster of claim 1 wherein the back wall also has a recessed channel defined therein and terminating at the cavity, the channel acts as a guide track for shiftably receiving the button head of the device as the device is inserted into the holster interior.

4. The holster of claim 2 wherein the recessed channel is defined in part by an angled wall formed in the back wall.

5. The holster of claim 1 wherein the first spring part is a bar spring mounted within the back wall adjacent to and spaced from the bottom wall to protrude into the holster interior.

6. The holster of claim 5 wherein the bar spring is metal.

7. The holster of claim 1 wherein the second spring part is a bar spring affixed to the back wall adjacent the bottom wall.

8. A holster for a handheld device where the device includes a quick connect mechanism having a button head extending laterally therefrom, the holster comprising:

a support frame; and a holster cover mounted to the support frame to define a holster interior for receiving the device therein, the support frame includes a back wall and bottom wall, the back wall has a cavity adapted to restrictively receive the button head of the device, the support frame also includes a first spring part extending over the bottom wall and a second spring part extending from the back wall, the second spring part adapted to exert an outward force on the device when the device is seated within the holster interior to push the device outward away from the support frame for seating the button head into the cavity of the back wall, the first spring part adapted to exert an upward force on the device when the device is seated within the holster interior to hold the button head within the cavity, thereby locking the device within the holster interior.

9. The device holster of claim 8 wherein the cavity is defined by an annular side wall having a back cut portion thereof forming a lip part, the button head to restrictively seat under the lip when the device is locking into the holster interior.

10. The device holster of claim 8 wherein the back wall also has a recessed channel defined therein and terminating at the cavity, the channel acts as a guide track for shiftably receiving the button head of the device as the device is inserted into the holster interior.

11. The device holster of claim 10 wherein the recessed channel is defined in part by an angled wall formed in the back wall.

12. The device holster of claim 1 wherein the first spring part is a bar spring protruding upward angularly from the bottom wall into the holster interior, the second spring part is a bar spring affixed to and extending over the back wall adjacent the bottom wall.

13. The holster of claim 12 wherein the bar spring is metal.

* * * * *